United States Patent [19]

Booty

[11] 4,173,382

[45] Nov. 6, 1979

[54] PORTABLE TRACK LIGHTING

[76] Inventor: Donald J. Booty, 513 Durham Dr., Frankfort, Ill. 60423

[21] Appl. No.: 845,991

[22] Filed: Oct. 27, 1977

Related U.S. Application Data

[63] Continuation-in-part of Ser. No. 763,184, Jan. 27, 1977, Pat. No. 4,099,817.

[51] Int. Cl.[2] ..... H01R 13/60

[52] U.S. Cl. ..... 339/22 B; 174/48; 339/75 R

[58] Field of Search ..... 339/20, 21 R, 21 S, 339/22 R, 22 B, 22 T, 23, 24, 34, 75 R, 75 M; 174/48; 248/317, 343

[56] References Cited

U.S. PATENT DOCUMENTS

| | | | |
|---|---|---|---|
| 2,856,592 | 10/1958 | Carlson | 339/21 R |
| 3,129,751 | 4/1964 | Weber | 248/317 |
| 3,345,022 | 10/1967 | Jorgensen | 174/48 |
| 3,559,146 | 1/1971 | Valtonen | 339/21 S |
| 3,792,413 | 2/1974 | Hyrlainen | 339/21 R |

*Primary Examiner*—Neil Abrams

*Attorney, Agent, or Firm*—Seidel, Gonda, Goldhammer & Panitch

[57] ABSTRACT

A lamp and support housing are adapted for movement along the length of a power supply track. The track is portable since it is removably connected to wall brackets. The housing supports movable contacts each adapted to be electrically coupled to a discrete conductor bus in the track. Access to the conductor buses is attained by way of slots on opposite faces of the track. A discrete actuator on the housing moves each contact between an inoperative retracted position and an operative extended position.

13 Claims, 6 Drawing Figures

PORTABLE TRACK LIGHTING

RELATED CASE

This application is a continuation-in-part of my pending application Ser. No. 763,184 entitled "Track Lighting" and filed Jan. 27, 1977 and now U.S. Pat. No. 4,099,817. Reference is also made to my recently issued U.S. Pat. No. 4,003,618.

BACKGROUND

The subject matter involved herein is believed to be classified in class 339. U.S. Pat. No. 2,977,576 is representative of prior art wherein the conductive buses are facing one another in a channel on the track. Conductive buses of that configuration are subject to accidental contact by way of a metal probe introduced into the channel. U.S. Pat. No. 2,309,972 is similarly objectionable for the same reason.

The provision of buses each having an entry slot on opposite faces of the track is known from U.S. Pat. Nos. 2,437,579; 2,856,592; and 2,261,986. In the last-mentioned patents, access to the conductive buses relies on flexibility of one or more components and/or relies on rotation of the entire housing. Neither of those concepts are considered to be practical and are not acceptable to approval by Underwriter Laboratories.

The present invention is an improvement over the above-mentioned co-pending application in that the track herein is removably connected to wall mounted brackets whereby the track is considered to be portable and has Underwriter approval as a portable track. In addition, the present invention provides a discrete actuator for each contact to facilitate ease of manufacture and provide a positive indicator that the contacts are in an operative or inoperative position.

SUMMARY OF THE INVENTION

The present invention includes a housing having a recess on one side thereof for embracing a track. A pair of movable contacts are supported by the housing. Actuator means is provided for selectively moving the contacts relative to the housing between an inoperative retracted position within the housing and an operative extended position wherein the free end of each contact is within the recess and adapted to engage a discrete conductor bus in the track. Wall mounted brackets are provided with structures releasably coupled to the track whereby the track is considered to be portable.

It is an object of the present invention to provide a portable track lighting which has increased safety features to prevent accidental contact with a conductor bus while being attractive, versatile, efficient, and having other features and advantages as will be made clear hereinafter.

For the purpose of illustrating the invention, there is shown in the drawings a form which is presently preferred; it being understood, however, that this invention is not limited to the precise arrangements and instrumentalities shown.

Figure 1:
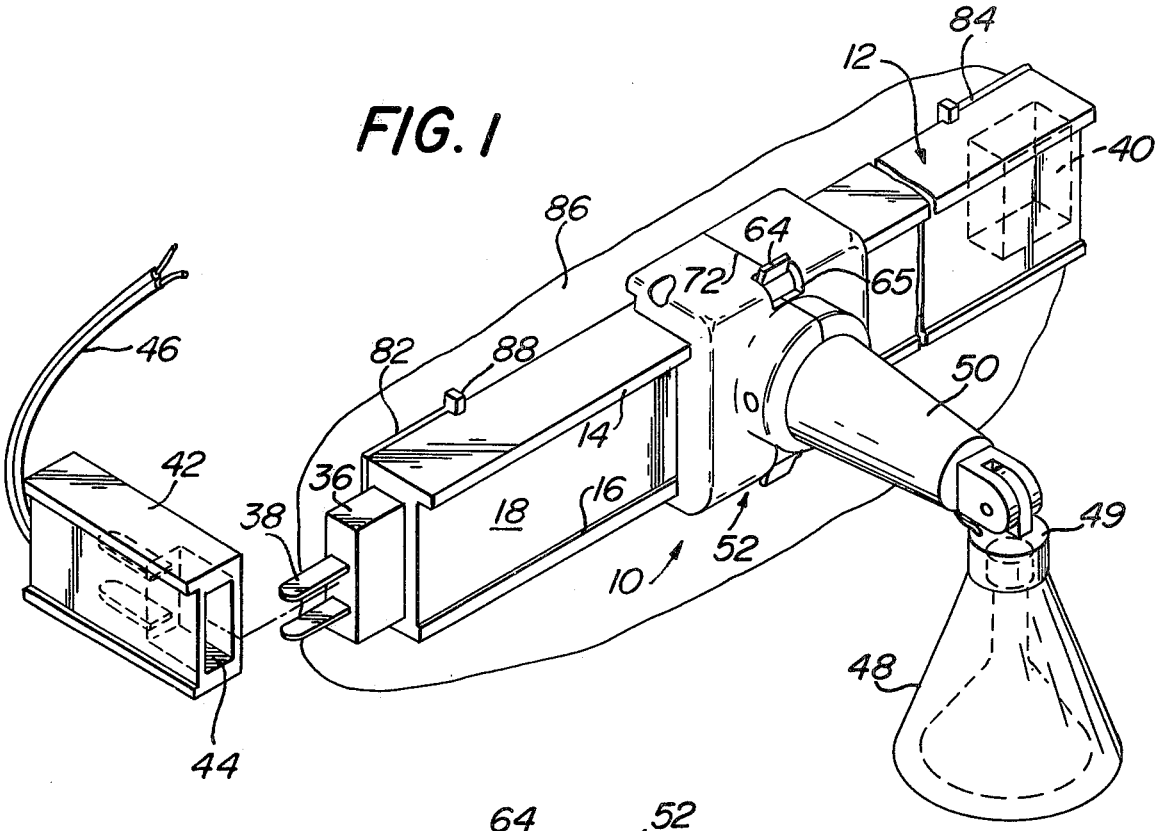
FIG. 1 is an exploded perspective view of the present invention.

Referring to the drawings in detail, wherein like numerals indicate like elements, there is shown in FIG. 1 a portable track lighting in accordance with the present invention designated generally as 10. A track 12 extruded from any suitable material such as plastic, aluminum or the like is provided. The track 12 has an upper guide rib 14 which projects out further than a lower guide rib 16 on the front face 18. The front face 18 may be decorated in any suitable manner so that the track 12 may be artistically and esthetically compatible with the surroundings.

The track 12 has a rear face 20 defined by a plurality of spaced parallel surfaces aligned with one another and having a centrally disposed longitudinally extending T-shaped recess 22. The recess 22 facilitates releasable securement of the track 12 to wall mounted brackets as will be made clear hereinafter. The track 12 has a pair of longitudinally extending slots which are parallel to the front face 18 and rear face 20. An electrical conductor bus 24 is disposed in one of the slots and a similar bus 26 is disposed in the other slot. If track 12 is made of metal, each bus is electrically insulated from the track. A slot 28 is provided in the side face 30 of the track and extends to the bus 24. The opposite side face 34 of the track is provided with a slot 32 which extends through the bus 26. See FIGS. 2 and 3. Each of the slots 28, 32 is curved, with the arcuate extent of the curve being approximately 90°, so that accidental or intentional contact with a bus by a probe is unlikely.

The track 12 is provided with a plug 36 at one end from which extend contacts 38 each coupled to one of the buses. The transverse dimensions of the plug 36 are less than the transverse dimensions of the track 12. The other end of the track 12 is provided with a socket 40 having female contacts electrically coupled to the buses 24, 26. The dimensions of the socket 40 are of such size so as to receive the plug 36 on an adjacent track whereby two adjacent tracks may be coupled together with no unsightly gap between them. State otherwise, the tracks 12 are adapted to be telescopically coupled to one another while simultaneously effecting electrical contact between the buses of one track and the buses of the other track.

A power connector 42 is provided. The connector 42 has a socket 44 adapted to receive plug 36 on track 12 so that the contacts 38 may be electrically coupled to the conductors 46. The connector 42 has transverse dimensions comparable to the dimensions of the track 12 and has the appearance of being a continuation thereof.

A lamp 48 is connected to receptacle 48 which is pivotably coupled to one end of a bracket arm 50. The other end of bracket arm 50 is connected to a housing 52. If described, arm 50 may be rotatable with respect to housing 52 with suitable lugs and limit stops being provided to limit the extent of rotation. Electrical conductors 54 extend through the bracket arm 50 to the receptacle 49. See FIGS. 1 and 4.

Figure 2:
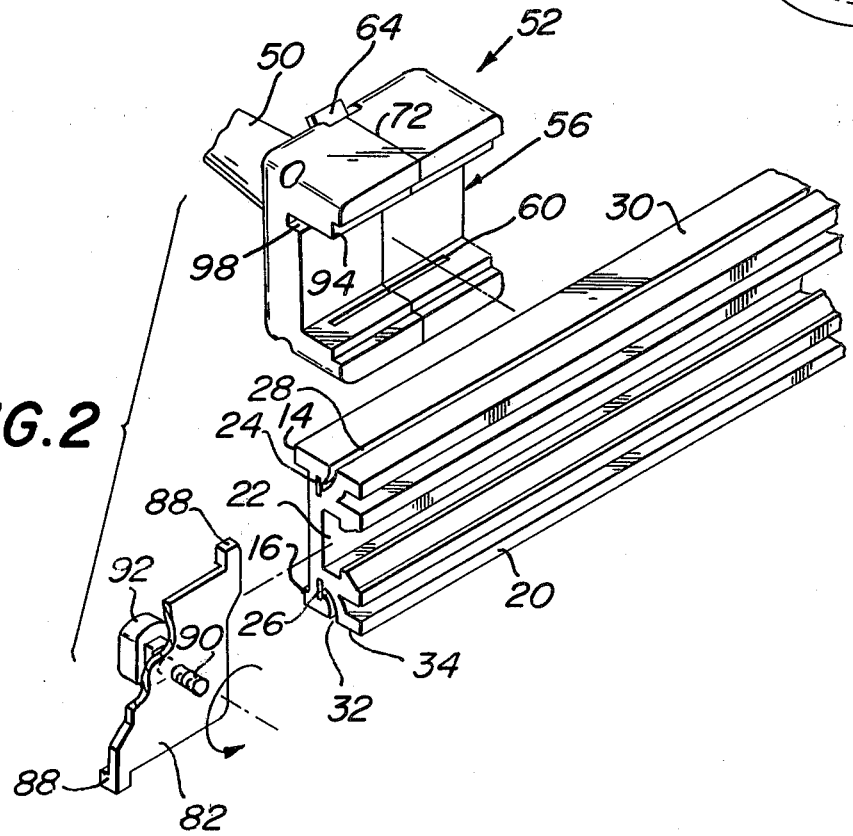
FIG. 2 is an exploded partial perspective view from the opposite side shown in FIG. 1.
Figure 3:
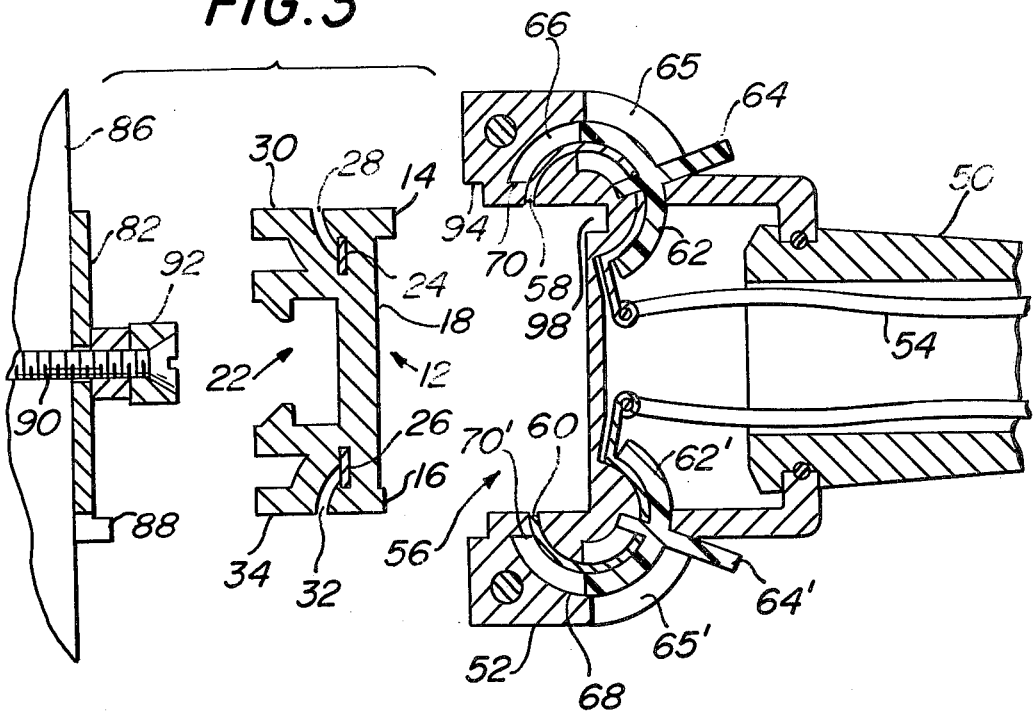
FIG. 3 is an exploded sectional view wherein the contacts are in their inoperative position.

As shown more clearly in FIGS. 2 and 3, the housing 52 has a recess 56 on its rear face for embracing the faces 18, 30 and 34 on the track 12. A pair of curved contacts 58, 60 are movably supported by the housing 52 adjacent opposite sides of said recess 56. Each of the contacts 58, 60 is electrically coupled to the receptacle 40 by one of the electrical conductors 54. See FIGS. 3 and 4. The housing 52 is provided with a curved passageway 66 which is aligned with the slot 28 in surface 30 of track 12 when the track 12 is disposed within the recess 56. Housing 52 is provided with a curved passageway 68 aligned with slot 32 in the track 12 when track 12 is disposed within recess 56.

An actuator means is provided for the contacts 58, 60. Such actuator means may include a single actuator for simultaneously moving the contacts 58, 60. For ease of manufacture and for providing an indicator for positively indicating the position of the contacts, they are preferably provided with discrete actuators. Since the actuators for the respective contacts 58, 60 are identical, only the actuator associated with contact 58 will be described in detail with corresponding primed numerals being provided on corresponding structure for the other actuator.

Figure 6:
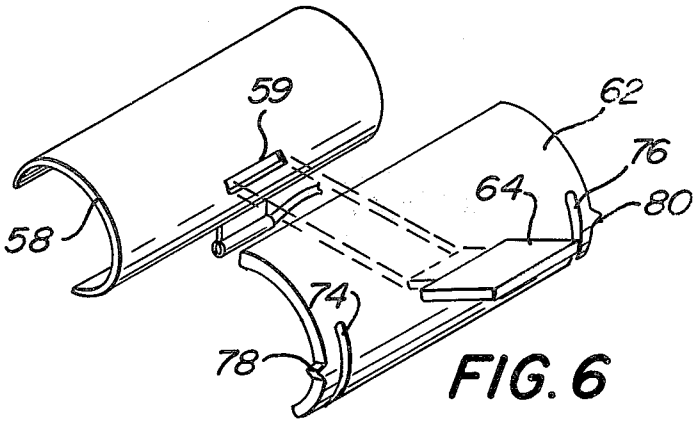
FIG. 6 is an exploded perspective view of one contact and its actuator.

Referring to FIG. 6, the contact 58 has a slot 59 which receives a similarly shaped tab on one surface of a curved actuator 62. The tab extends through slot 59 and into a groove on the juxtaposed curved surface of the housing 52. Actuator 62 has a tongue 64 on its surface opposite from the tab. Actuator 62 is made from an electrically non-conductive material such as polymeric plastic. The curved passageway 66 is provided with dimensions suitable to accomodate both the actuator 62 and contact 58 as will be apparent from a comparison of FIGS. 3 and 4. The tongue 64 extends through an opening 65 in the housing 52 and is of sufficient length so as to be readily manipulatable by the fingers of an operator.

Figure 4:
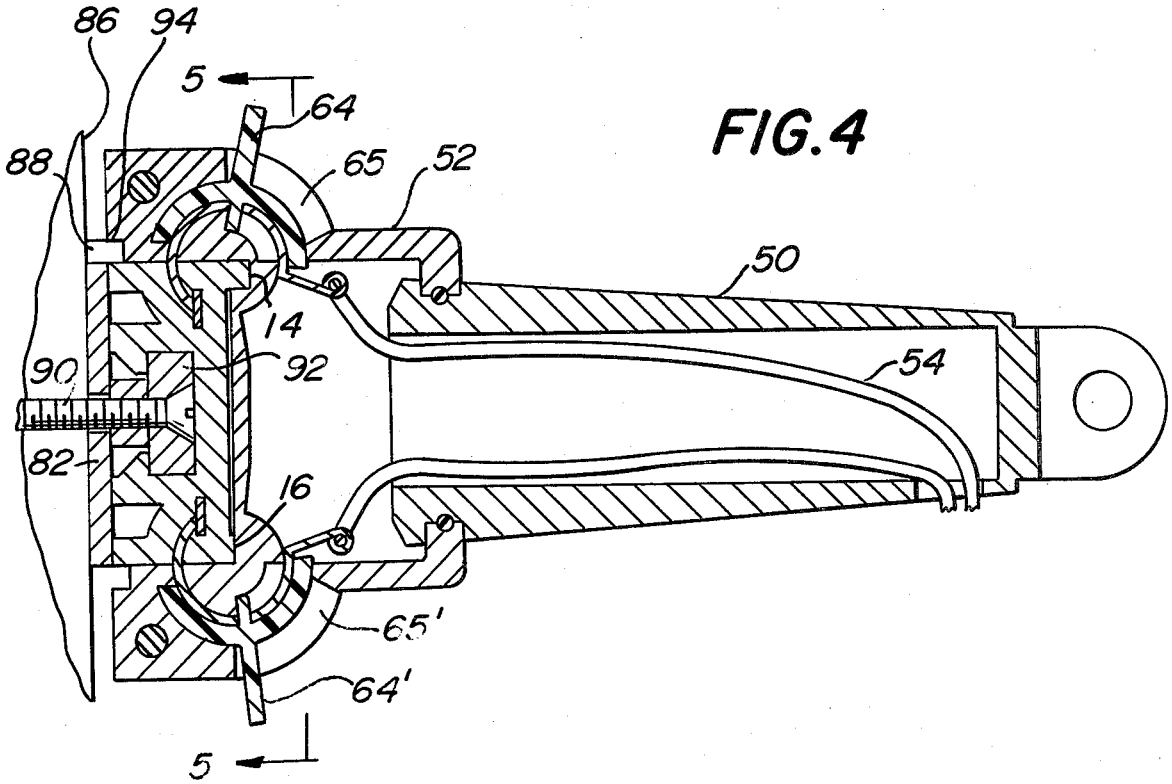
FIG. 4 is a sectional view of the track mounted on its bracket and with the contacts in their operative position.

Passageway 66 and slot 28 have a common radius of curvature. Passageway 68 and slot 32 have a common radius of curvature. The contacts 58 and 60 are supported for movement between an inoperative retracted position wherein the contacts are disposed entirely within their respective curved passageways (see FIG. 3) and an extended operative position as shown in FIG. 4. It will be noted that the actuators 62, 62' are made from an electrically non-conductive material which embraces a substantial portion of the arcuate surface of the contacts, adds rigidity to the contacts, and constitute limit stops for cooperating with the shoulders 70, 70' respectively.

To facilitate assembly of the housing 52, it is preferably molded or cast from suitable material such as aluminum, plastic, and the like which are formed in two halves. The housing halves are joined together along a centrally disposed parting line 72. See FIGS. 1 and 2. One or both of the housing halves may be provided with suitable indicia such as ON and OFF adjacent the openings 65, 65'. Each of the actuators 64, 64' is readily visible and easily manipulatable by one's fingers between the ON and OFF positions. The physical location of the actuators is an indication of whether or not the housing 52 is locked to the track 12 by way of the contacts being in their operative position as shown in FIG. 4.

If desired, the actuators may be provided with parallel slots 74, 76 adjacent the ends thereof so as to define spring portions having protrusions 78, 80 which snap into a recess in a side face of the housing 52 at the ON and OFF position of the actuators. The ON position of the actuator corresponds to the operative position of the contacts. See FIGS. 5 and 6.

A number of track connector brackets like 82 and 84 are secured to a wall 86. The brackets are identical. Hence, only bracket 82 will be described in detail.

Figure 5:
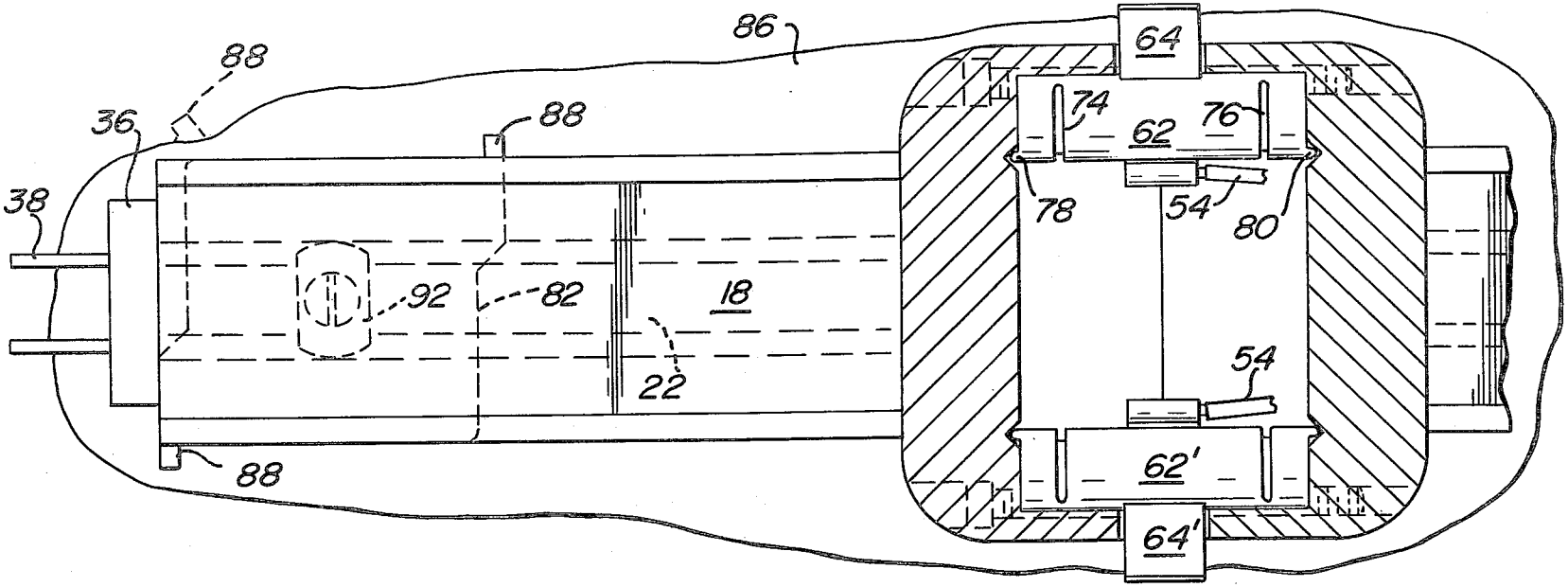
FIG. 5 is a view taken along the line 5—5 in FIG. 4.

The bracket 82 is generally rectangular with appropriate dimensions so as to be obscured by the track except for finger grips 88 which are diagonally disposed. See the lefthand end of FIG. 5. The brackets 82, 84 are secured to the wall 86 and spaced from one other by a dimension which is approximately six inches, or close enough to give sufficient support to mounted lamps. The brackets are rotatable about the axis of a mounting bolts 90. A rectangular locking member 92 is secured to and rotates with the bracket 82. In the position of the locking member 92 as shown in FIG. 3, it is easily insertable into the T-shaped recess 22 on the rear surface of the track 12. When the bracket 82 is rotated by way of the grips 88 through an arc of approximately 90°, the locking member 92 assumes the position shown in FIGS. 4 and 5 thereby releasably locking the track to the bracket. To release the track 12 from the bracket 82, finger grip 88 is rotated through an arc of 90° counterclockwise to the phantom position as seen in FIG. 5. Such rotation will cause the locking member 92 to rotate 90° whereby it will then be easily removable from the recess 22. The housing 52 is provided with suitable notches 94, see FIG. 3, so that housing 52 may be slid along the length of track 12 or may be attached to track 12 in any position without causing contact between housing 52 and the finger grips 88.

The track upper guide rib 14 extends out from the track and fits into slot 98 of the housing 52 when it is embracing the track 12. Lower rib 16 extends only slightly and has no corresponding slot in housing 52. This arrangement mechanically establishes an electrical polarity of the device as required by underwriters in all portable electric light devices. If the housing 52 is placed over the track 12 in a reversed manner, so that rib 16 was opposite slot 98, rib 14 would cause a displacement of the entire housing 52, and the curved contacts 58, 60 would be unable to enter the respective slots 28, 32 in the track 12. The guide ribs 14 and 16 also serve to facilitate application of decorative strips to the track on face 18.

In view of the above description, the manner in which the housing 52 and the lamp and/or receptacle supported thereby is coupled to the track 12 should be readily apparent to those skilled in the art. Before attaching the housing 52 to the track 12, actuators 64, 64' are rotated to the position shown in FIG. 3 thereby retracting the contacts 58, 60 to their inoperative position. The housing 52 is positioned so that the track 12 is received within recess 56. The actuators 64, 64' are sequentially rotated to the position shown in FIG. 4. As a result thereof, the contacts 58, 60 are in contact with the buses 24, 26 respectively and the housing 52 is locked to the track 12. The housing 52 may be slid along the length of the track 12 and this is preferably accomplished after partially rotating the actuators 64, 64' so that the contacts do not rub against their respective buses. The contacts 58, 60 preferably have sufficient bending strength so as to support the housing 52 and lamp 48 when the track 12 is secured to a ceiling.

The common center of curvature of contact 58, its passageway 66, and the associated slot 28 is parallel to the length of the associated bus 24. The same is true for contacts 60, slot 32 and passageway 68. It will be noted that most of the components of the present invention are extrudable or cast to shape so as to minimize machining requirements. Further, it will be noted that the track 12 will be readily disengaged for a number of brackets like 82 and 84 on one wall and attached to a number of similar brackets on another wall in a facile manner.

The present invention may be embodied in other specific forms without departing from the spirit or essential attributes thereof and, accordingly, reference should be made to the appended claims, rather than to the foregoing specification as indicating the scope of the invention.

I claim:

1. Apparatus comprising a housing having a recess on one side thereof for enabling the housing to embrace outer peripheral faces of a track, a pair of curved passageways supported by the housing adjacent opposite sides of said recess, a pair of curved electrical contacts whose curvature corresponds to that of said passageway, each contact being at least partially disposed in one of said passageways, actuator means supported by said housing and being coupled to said contacts for selectively moving said contacts relative to said housing between an inoperative retracted position wherein free end portions of said contacts are in said housing passageways and an operative extended position wherein said contact end portions extend into said recess, a track in said recess and embraced by said housing, said track having a curved slot on opposite faces for receiving one of said contacts, each track slot being aligned with and forming an extension of one of said passageways, each track slot terminating in a bus, each contact being adapted to engage one of said buses only when in its operative position, bracket means adapted to be attached to a supporting wall surface, said bracket means including a locking member, said track having a recess on a rear face thereof, said locking member being adapted to enter said recess and releasably latch the track to said locking member.

2. Apparatus in accordance with claim 1 wherein said bracket means includes a plurality of discrete brackets, the locking member of each bracket being rotatable through an arc of approximately 90° to facilitate locking and unlocking the track with respect to each bracket, and a means associated with each locking member to facilitate its rotation.

3. Apparatus in accordance with claim 1 including means for facilitating adjustment of the track in a longitudinal direction with respect to said bracket means without interferring with the locking of the track to said bracket means.

4. Apparatus comprising a housing having a recess on one side thereof for enabling the housing to embrace outer peripheral faces of a track, a pair of passageways supported by the housing adjacent opposite sides of said recess, a pair of electrical contacts, each contact being at least partially disposed in one of said passageways, actuator means supported by said housing and being attached to said contacts for selectively moving said contacts relative to said housing between an inoperative retracted position wherein said contacts are in their respective housing passageways and an operative extended position wherein said contacts extend into said recess, an elongated track in said recess and partially embraced by said housing, said track having a slot on opposite faces, each slot being adapted to receive one of said contacts, each track slot being aligned with one of said passageways, each track slot including a bus, each contact being adapted to enter a track slot and engage one of said buses only when in its operative position, bracket means adapted to be attached to a supporting wall surface, said bracket means including a locking member, said track having means on a rear face thereof for cooperation with said locking member to releasably latch the track to said locking member.

5. Apparatus in accordance with claim 4 including actuator means for moving one of said locking member and said track means to latch and unlatch the track with respect to said bracket means.

6. Apparatus comprising an elongated track having a recess on a rear face thereof, said track having a pair of elongated spaced electrical conductors with each conductor being accessible from a discrete outside face of the track, bracket means adapted to be rotatably supported by a wall, said bracket means including a locking means which can enter said track recess in one rotative position thereof and releasably lock the track to the bracket means in another rotative position thereof, a housing having a recess, said track being disposed within said recess so that said housing overlies said discrete outside faces of the track, said housing having a pair of contacts, each contact being movable from an inoperative position within said housing to an operative position wherein each contact projects out of the housing and engages one of said conductors, and actuator means on said housing for moving said contacts between their operative and inoperative positions including a discrete actuator being attached to each contact, each actuator extending through a separate opening in said housing.

7. Apparatus in accordance with claim 6 wherein said bracket means includes a plurality of discrete brackets, each bracket having a means to facilitate rotation of the bracket and its associated locking means, and said recess on said rear face of said track being generally T-shaped.

8. Apparatus in accordance with claim 6 wherein each actuator includes a portion which overlies a major section of the surface of one of said contacts.

9. Apparatus in accordance with claim 6 wherein each actuator is provided with a snap lock to latch the actuator in its operative and inoperative positions.

10. Apparatus in accordance with claim 6 wherein said track and housing have cooperating structure so that there is only one correct disposition of said housing recess for receiving said track thereby establishing a polarized coupling arrangement.

11. Apparatus comprising a portable elongated track having a recess on a rear face thereof, said track having a pair of elongated spaced electrical conductors, one outer peripheral face of said track having a slot extending to one of said conductors, another outer peripheral face of said track having a slot extending to the other of said conductors, a plurality of bracket means adapted to be removably supported by a wall, each bracket means including a locking means which can enter said track recess and releasably lock the track to the bracket means, a housing having walls defining a U-shaped recess, said recess walls having passageways, a portion of said track faces being disposed within said housing recess, means at least in part in said housing recess for establishing a polarity between said housing recess and said track so that said track can only enter said housing recess in one disposition of the housing, and said housing having a pair of contacts each selectively movable by actuator means including a separate actuator attached to each contact from an inoperative position within the housing through one of said passageways to an operative position wherein each contact extends through one of said slots and engages one of said conductors.

12. Apparatus in accordance with claim 11 wherein said contacts are curved toward a front wall of the track about axes generally parallel to said track faces.

13. Apparatus comprising an elongated track having a recess on a rear face thereof, said track having a pair of elongated spaced electrical conductors with each conductor being accessible from a discrete side face of the track, bracket means adapted to be rotatably supported by a wall, said bracket means including a locking means which can enter said track recess in one rotative position thereof and releasably lock the track to the bracket means in another rotative position thereof, a housing having a recess, said track being disposed within said recess so that said housing overlies said discrete faces of the track, said housing having a pair of contacts, each contact being movable from an inoperative position within said housing to an operative position wherein each contact projects out of the housing and engages one of said conductors, and actuator means on said housing for moving said contacts between their operative and inoperative positions including a discrete actuator for each contact, each actuator extending through a separate opening in said housing, wherein each contact and a juxtaposed portion of its actuator are curved, said housing have a curved passageway for guiding each contact and its associated curved actuator portion, the arcuate extent of each actuator being greater than the arcuate extent of its associated actuator portion so that the associated curved actuator portion does not project into the recess on said housing in the operative position of the contacts.

* * * * *